US010250991B2

(12) United States Patent
Wang et al.

(10) Patent No.: US 10,250,991 B2
(45) Date of Patent: Apr. 2, 2019

(54) VIBRATION LOUDSPEAKER

(71) Applicant: GOERTEK INC., WeiFang (CN)

(72) Inventors: Jizong Wang, WeiFang (CN); Dong Li, WeiFang (CN); Chao Xu, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/573,443

(22) PCT Filed: Nov. 16, 2015

(86) PCT No.: PCT/CN2015/094677
§ 371 (c)(1),
(2) Date: Nov. 10, 2017

(87) PCT Pub. No.: WO2016/179995
PCT Pub. Date: Nov. 17, 2016

(65) Prior Publication Data

US 2018/0139541 A1 May 17, 2018

(30) Foreign Application Priority Data

May 13, 2015 (CN) ..... 2015 1 0243239

(51) Int. Cl.
*H04R 1/02* (2006.01)
*H04R 9/06* (2006.01)
*H04R 9/02* (2006.01)

(52) U.S. Cl.
CPC ..... *H04R 9/06* (2013.01); *H04R 1/025* (2013.01); *H04R 9/025* (2013.01);
(Continued)

(58) Field of Classification Search
CPC ..... H04R 1/28; H04R 1/2815–1/2826; H04R 1/02; H04R 1/025; H04R 1/026
(Continued)

(56) References Cited

U.S. PATENT DOCUMENTS 4,439,643 A * 3/1984 Schweizer ..... H04R 1/021 181/153
5,956,412 A * 9/1999 Park ..... H04R 1/025 181/151

(Continued)

FOREIGN PATENT DOCUMENTS

CN 1838833 A 9/2006
CN 2831491 Y 10/2006

(Continued)

OTHER PUBLICATIONS

International Search Report for PCT/CN2015/094677 filed on Nov. 16, 2015.

*Primary Examiner* — Suhan Ni

(57) ABSTRACT

Disclosed is a vibration loudspeaker, comprising a housing, a back lid matching the housing, and a vibration system and a magnetic circuit system in the housing; the housing and the back lid are both square-shaped structures; the four corners of the square-shaped structure of the housing are provided with a recess, and the four corners of the back lid corresponding to the four corners of the housing are provided with a step, such that the back lid and the housing snap together and fix to each other. The vibration loudspeaker of the present invention effectively enhances the firmness of the fitting between the back lid and the housing, thereby enhancing the overall strength of the vibration loudspeaker product of the present invention. The vibration loudspeaker of the present invention has high overall strength, good reliability, and strong shock resistance.

8 Claims, 3 Drawing Sheets

(52) U.S. Cl.
CPC ..... *H04R 2400/03* (2013.01); *H04R 2400/07* (2013.01); *H04R 2400/11* (2013.01)

(58) Field of Classification Search
USPC ..... 381/345–351, 386, 388–390
See application file for complete search history.

(56) References Cited

U.S. PATENT DOCUMENTS

| | | | | |
|---|---|---|---|---|
| 7,561,684 | B2 * | 7/2009 | Tsutaichi | H04M 1/03 379/433.01 |
| 2003/0138123 | A1 * | 7/2003 | Evenisse | H04R 1/025 381/386 |
| 2005/0147270 | A1 * | 7/2005 | Hecht | H04R 1/026 381/386 |
| 2010/0177469 | A1 | 7/2010 | Wang | |

FOREIGN PATENT DOCUMENTS

| | | | |
|---|---|---|---|
| CN | 203086725 | U | 7/2013 |
| CN | 104883648 | A | 9/2015 |
| WO | WO 2011/003333 | A1 | 1/2011 |

* cited by examiner

VIBRATION LOUDSPEAKER

CROSS-REFERENCE TO RELATED APPLICATIONS

The present specification is a U.S. National Stage of International Patent Application No. PCT/CN2015/094677, filed Nov. 16, 2015, which claims priority to and the benefit of Chinese Patent Application No. 201510243239.6, filed May 13, 2015, the entire contents of which are incorporated herein by reference.

TECHNICAL FIELD

The present invention relates to the technical field of electro-acoustic products, and more particularly to a vibration loudspeaker.

BACKGROUND

A vibration loudspeaker is a multi-functional acoustic device, which may not only achieve vibration sound functionality as a conventional loudspeaker, but also achieve vibrating motor functionality. The vibration loudspeaker may save the internal space of a portable electronic terminal, simplify the assembly process of the portable electronic terminal, and reduce the cost of the portable electronic terminal. Therefore, the vibration loudspeaker has been increasingly and widely used in the field of portable electronic terminal.

The structure of the vibration loudspeaker in prior art mainly comprises a housing, and a back lid fitted with the housing. The back lid and the housing form a cavity, and the vibration system and the magnetic circuit system are accommodated and fixed in the cavity. With the improvement on the thickness-reduced design of the portable electronic terminal equipment, the thickness-reduced design of the vibration loudspeaker is getting better and better. Meanwhile, in order to meet the requirements on performance, the requirements on performance, such as sound and vibration, of the vibration loudspeaker is getting higher and higher. The housing of the thickness-reduced design reduces the strength of the fitting between the housing and the back lid. When the vibration loudspeaker vibrates, the back lid is prone to deform due to the impact, and the back lid is prone to be separated from the housing, which reduce the reliability of the vibration loudspeaker. Therefore, how to improve the firmness of the fitting between the back lid and housing and improve the overall strength of the production has become the focus in the industry.

SUMMARY

The technical problem sought to be solved by the present invention is to provide a vibration loudspeaker with a high overall strength, a good reliability, and a strong impact resistance.

In order to achieve the above objective, the present invention adopts the following technical solution:

A vibration loudspeaker comprises a housing, a back lid matching the housing, and a vibration system and a magnetic circuit system accommodated in the housing; the housing and the back lid both have square-shaped structures; four corners of the square-shaped structure of the housing are provided with recesses, and the back lid is provided with steps at places corresponding to the recesses of the four corners of the housing, such that the back lid and the housing snap together and fix to each other.

As a preferred embodiment, the housing is provided with positioning structures at positions of the recesses, and the back lid is provided with location holes corresponding to the positioning structures.

As a further preferred embodiment, the positioning structures are provided in all of the recesses of the four corners of the housing, the recess of each of the corners of the housing is provided with two positioning structures, the housing is provided with eight positioning structures, and the back lid is correspondingly provided with eight location holes.

As a further preferred embodiment, the positioning structures are hot-melt columns.

As a preferred embodiment, the housing with the square-shaped structure is further provided with positioning bosses extending laterally.

As a further preferred embodiment, a number of the positioning bosses are two, and the two positioning bosses are provided at both ends of a side of the square-shaped housing, respectively.

As another further preferred embodiment, a number of the positioning bosses are two, and the two positioning bosses are provided at the middle position of a side of the square-shaped housing, respectively.

As a preferred embodiment, the vibration loudspeaker further comprises electric connecting pieces, and the electric connecting pieces are provided on the positioning bosses.

As a further preferred embodiment, the electric connecting pieces are springs.

As another further preferred embodiment, the electric connecting pieces are leaf springs.

In the vibration loudspeaker of the present invention, the four corners of the square-shaped structure of the housing are provided with recesses, and the back lid is provided with steps at places corresponding to the recesses, that is, the ends of the sides of the square-shaped back lid are provided with steps, and the stepped structure of the back lid corresponds to the recesses of the housing, and the back lid and the housing snap together. The vibration loudspeaker of such structure can effectively enhance the firmness of the fitting between the back lid and the housing, thereby enhancing the overall strength of the vibration loudspeaker product of the present invention.

As a preferred embodiment, positioning structures are provided in the recesses of the housing, and the back lid is provided with location holes corresponding to the positioning structures, and the location holes are fitted with the positioning structures to further improve the firmness of the fixation between the back lid and the housing. As a further preferred embodiment, two positioning structures are provided in the recess of each of the corners of the square-shaped housing. Both ends of the four sides of the square-shaped housing are provided with positioning structures in the recesses of the corners, that is, the square-shaped housing is provided with eight positioning structures, the back lid is correspondingly provided with eight location holes to further improve the fitting firmness. The positioning structures of the housing can be hot-melt columns. The eight hot-melt columns are tightly combined with the back lid after being hot-melted, which increases the strength of hot-melting, improves the firmness of the combination between the back lid and the housing, and effectively disperses the external pressure applied to the back lid, thereby preventing the deformation of the back lid, and improving the impact resistance capacity of the product.

In order to enable that the vibration loudspeaker of the present invention is fixedly combined to the portable electronic device, positioning bosses are laterally provided on the housing. The positioning bosses may be provided at both ends or in the middle of the side of the square-shaped housing according to actual condition. In order to simplify the design difficulty and improve the utilization of the internal space of the vibration loudspeaker, the electric connecting pieces of the vibration loudspeaker of the present invention are provided on the positioning bosses, and the electric connecting pieces may be springs, leaf springs, and other structures.

In summary, the vibration loudspeaker of the present invention has a high overall strength, a good reliability, and a strong shock resistance.

DETAILED DESCRIPTION OF THE PREFERRED EMBODIMENTS

The contents of the present invention will be described in detail with reference to the accompanying drawings.

Figure 1:
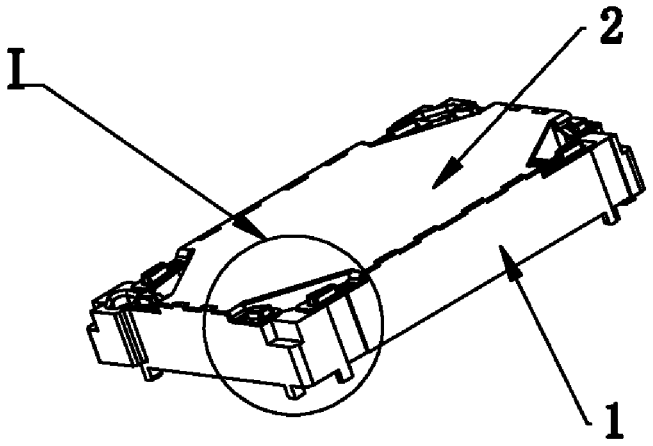
FIG. 1 is a perspective view of a vibration loudspeaker according to a particular embodiment of the present invention.
Figure 2:
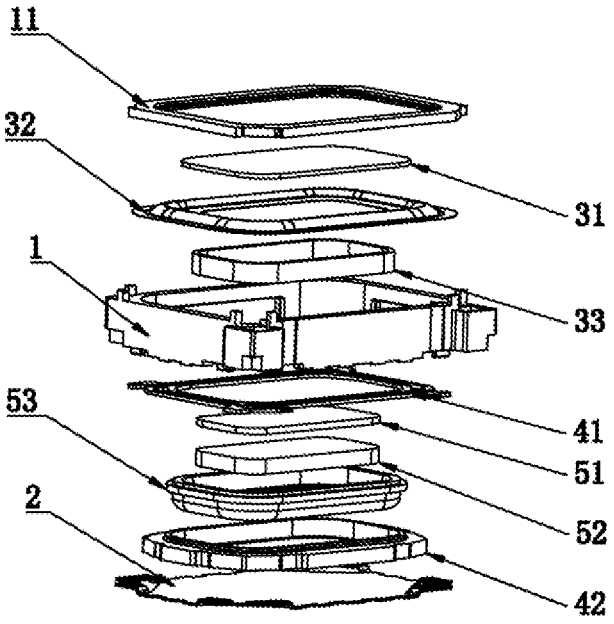
FIG. 2 is an exploded view of the vibration loudspeaker shown in FIG. 1.
Figure 3:
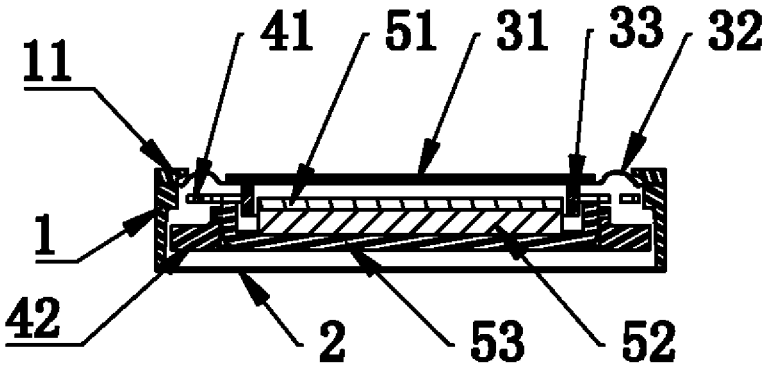
FIG. 3 is a cross-sectional view of the vibration loudspeaker shown in FIG. 1.

As shown in FIGS. 1, 2 and 3, the vibration loudspeaker according to the present invention comprises a housing 1, a back lid 2 fixedly matching with one end of the housing 1, and a front cover 11 fixed to the other end of the housing 1. The housing 1, the back lid 2 and the front cover 11 cooperate to form a cavity for accommodating and fixing a vibration system and a magnetic circuit system. As shown in FIGS. 2 and 3, the vibration system comprises a diaphragm 32, a reinforcing portion 31 fixed to the diaphragm and a voice coil 33. The voice coil 33 and the reinforcing portion 31 are fixed to the housing 1 through the diaphragm 32. The magnetic circuit system comprises a washer 51, a magnet 52 and a basin frame 53, which are fixedly combined together sequentially. The magnet 52 and the washer 51 are fixed inside the basin frame 53 and form a magnetic gap between side walls of the basin frame 53, and the voice coil 33 of the vibration system is suspended in the magnetic gap. As shown in FIGS. 2 and 3, the vibration loudspeaker of the present invention further comprises a support piece 41 and a mass block 42. As shown in FIG. 3, the mass block 42 has an annular structure, and the mass block 42 is circlewise provided on the outer side of the basin frame 53 and fixed to the basin frame 53. The support piece 41 comprises a second fixing portion provided inside and a first fixing portion fixed to the housing, and the second fixing portion of the support piece 41 is fixed to the frame basin 53. The basin frame 53 is suspended inside the housing 1 through the support piece 41. When the vibration loudspeaker of the present invention is operated, the voice coil 33 is supplied with a drive current. As the voice coil 33 is provided in the magnetic gap, the voice coil is applied with Lorentz force due to the varied current in the voice coil 33 provided in the magnetic field. At the same time, the magnetic circuit system suspended in the housing 1 is applied with a reaction force. When the voice coil 33 is supplied with a low frequency signal, the reaction force applied to the magnetic circuit system is resonated with the mass block, and thus the vibration sense of the vibration loudspeaker is obvious, and the vibration loudspeaker may function to vibrate. When the voice coil 33 is supplied with a relatively higher frequency signal, the voice coil 33 vibrates significantly so as to drive the diaphragm 32 to vibrate and emit a sound, and thus the vibration loudspeaker functions to emit the sound. The vibration loudspeaker of the present invention is added with a vibration function on the basis of a loudspeaker, and saves the internal space and the assembling process of a portable electronic terminal.

Figure 4:
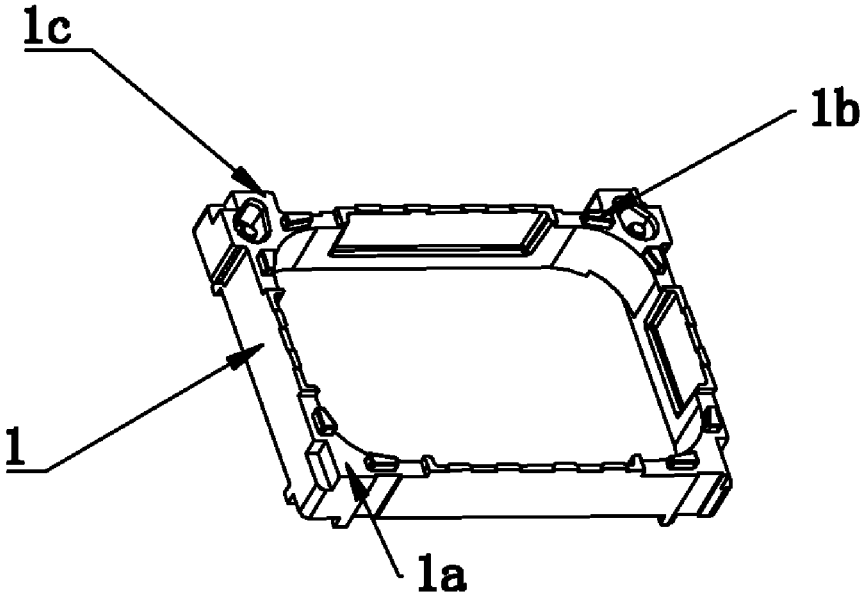
FIG. 4 is a perspective view of the structure of the housing of a vibration loudspeaker of the present embodiment.
Figure 6:
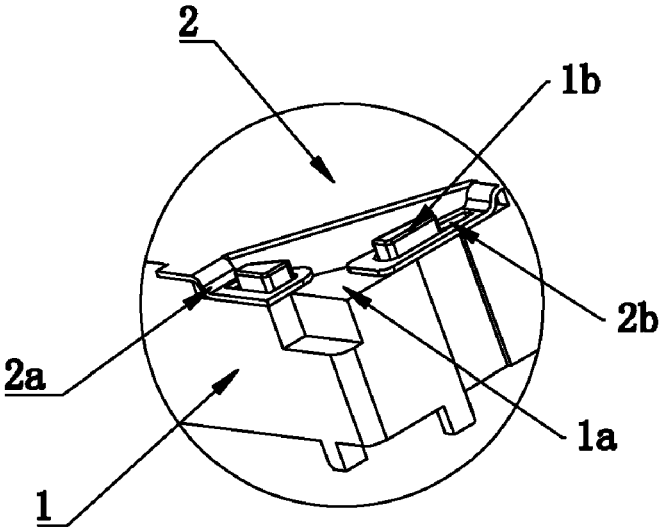
FIG. 6 is an enlarged view of part I of the vibration loudspeaker shown in FIG. 1.

As shown in FIGS. 1, 4 and 6, in the vibration loudspeaker of the present invention, the housing 1 has a square-shaped structure, and the back lid 2 correspondingly has a square-shaped structure. The four corners of the housing 1 are provided with recesses 1*a*, the back lid 2 is provided with steps 2*a* at places corresponding to the recesses 1*a*, that is, both ends of the four sides of the square-shaped back lid 2 are provided with steps 2*a*, and the back lid 2 and the housing 1 are snapped together and fixed by the recesses 1*a* and the steps 2*a*. The vibration loudspeaker of such structure effectively enhances the firmness of the fixation between the back lid 2 and the housing 1, thereby enhancing the overall strength of the vibration loudspeaker of the present invention.

Figure 5:
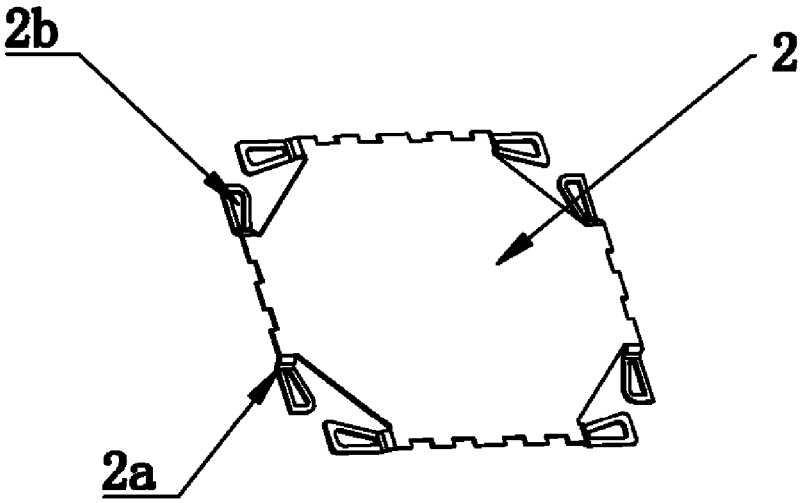
FIG. 5 is a perspective view of the structure of the back lid of the vibration loudspeaker of the present embodiment.

As a preferred embodiment, positioning structures 1*b* are provided in the recesses 1*a* of the corners of the housing 1, as shown in FIGS. 4 and 6. The housing 2 is provided with location holes 2*b* corresponding to the positioning structures 1*b*, as shown in FIGS. 5 and 6. In the vibration loudspeaker according to the present embodiment, two positioning structures 1*b* are provided in the recesses 1*a*, and the positioning structures 1*b* are provided at both ends of the four sides of the square-shaped housing 1, respectively. The location holes 2*b* in the back lid 2 are provided to correspond to the positioning structures 1*b*. The positioning structures 1*b* of the present embodiment are hot-melt columns. The hot-melt columns 1*b* are hot-melted after fitted with the location holes 2*b*, thereby further improving the firmness of the fitting between the back lid 2 and the housing 1. In addition, the eight hot-melt columns 1*b* are tightly combined with the back lid after being hot-melted, which effectively disperses the external pressure applied to the back lid 2, thereby preventing the deformation of the back lid 2, and improving the impact resistance capacity of the product.

As shown in FIG. 4, in order to improve the effective cooperation with the external portable electronic device when the vibration loudspeaker is assembled, the vibration loudspeaker of the present invention is further provided with positioning bosses 1*c* which are lateral extensions on the housing 1. In the present embodiment, the number of the positioning bosses 1*c* is two, and the positioning bosses are provided at both ends of the long side of the housing 1. In practical applications, the positioning bosses may be provided at both ends of the short side or may be provided at the middle of the side, both of which can achieve the advantages of the vibration loudspeaker of the present invention.

The vibration loudspeaker of the present invention further comprises electric connecting pieces which electrically connect the voice coil with the external drive circuit. In order to improve the utilization of the internal space of the vibration loudspeaker, the electric connecting pieces can be arranged on the positioning bosses, which do not occupy the internal space of the vibration loudspeaker, and facilitates the improvement of the performance of the vibration loudspeaker. In practical applications, the electric connecting pieces may be springs or leaf springs.

In the vibration loudspeaker of the present invention, the four corners of the square-shaped structure of the housing are provided with recesses, and the back lid is provided with steps at places corresponding to the recesses, that is, the ends of the sides of the square-shaped back lid are provided with steps, and the stepped structures of the back lid correspond to the recesses of the housing, and the back lid and the housing snap together. The vibration loudspeaker of such structure effectively enhances the firmness of the fitting between the back lid and the housing, thereby enhancing the overall strength of the vibration loudspeaker product of the present invention.

The vibration loudspeaker of the present invention has a high overall strength, a good reliability, and a strong impact resistance.

The above mentioned are only embodiments of the present invention and are not for limiting the present invention, thus the equivalent modification or variation made by those skilled in the art according to the present invention should be incorporated into the protection scope recited in the claims.

The invention claimed is:

1. A vibration loudspeaker, comprising a housing, a back lid matching the housing, and a vibration system and a magnetic circuit system accommodated in the housing, wherein the housing and the back lid both have square-shaped structures, four corners of the square-shaped structure of the housing are provided with recesses, and the back lid is provided with steps at places corresponding to the recesses of the corners of the housing, and the back lid and the housing snap together and fix to each other, wherein positioning structures are provided in the recesses of the four corners of the housing, the recess of each of the corners of the housing is provided with two positioning structures, the housing is provided with eight positioning structures, and the back lid is provided with eight location holes at positions corresponding to the position structures.

2. The vibration loudspeaker according to claim 1, wherein the positioning structures are hot-melt columns.

3. The vibration loudspeaker according to claim 1, wherein the housing having the square-shaped structure is further provided with positioning bosses extending laterally.

4. The vibration loudspeaker according to claim 3, wherein a number of the positioning bosses are two, and the two positioning bosses are provided at both ends of a side of the square-shaped housing, respectively.

5. The vibration loudspeaker according to claim 3, wherein a number of the positioning bosses are two, and the two positioning bosses are provided at the middle of a side of the square-shaped housing, respectively.

6. The vibration loudspeaker according to claim 3, wherein the vibration loudspeaker further comprises electric connecting pieces, the electric connecting pieces are provided on the positioning bosses.

7. The vibration loudspeaker according to claim 6, wherein the electric connecting pieces are springs.

8. The vibration loudspeaker according to claim 6, wherein the electric connecting pieces are leaf springs.

* * * * *